US007308722B2

(12) United States Patent
Koren

(10) Patent No.: US 7,308,722 B2
(45) Date of Patent: Dec. 18, 2007

(54) SPA COVER LIFTER

(76) Inventor: George Koren, 154 Pinewood Dr., Evergreen, CO (US) 80439

( * ) Notice: Subject to any disclaimer, the term of this patent is extended or adjusted under 35 U.S.C. 154(b) by 280 days.

(21) Appl. No.: 11/101,231

(22) Filed: Apr. 7, 2005

(65) Prior Publication Data

US 2006/0225197 A1 Oct. 12, 2006

(51) Int. Cl.
*E04H 4/00* (2006.01)

(52) U.S. Cl. ..... 4/498

(58) Field of Classification Search ..... 4/498
See application file for complete search history.

(56) References Cited

U.S. PATENT DOCUMENTS

| | | | |
|---|---|---|---|
| 4,991,238 | A | 2/1991 | Forrest |
| 5,048,153 | A | 9/1991 | Wall et al. |
| 5,131,102 | A | 7/1992 | Salley et al. |
| 5,471,685 | A | 12/1995 | Cross |
| 5,517,703 | A | 5/1996 | Ouelette |
| 5,566,403 | A | 10/1996 | Black et al. |
| 5,584,081 | A | 12/1996 | Ouelette |
| 5,634,218 | A | 6/1997 | Ouelette |
| 5,644,803 | A | 7/1997 | Wilson |
| 5,689,841 | A | 11/1997 | Black et al. |
| 5,819,332 | A | 10/1998 | Perry |
| 5,950,252 | A | 9/1999 | Fettes |
| 5,974,599 | A | 11/1999 | Tudor |
| 5,974,600 | A | 11/1999 | Pucci et al. |
| 5,996,137 | A | 12/1999 | Genova |
| 6,000,071 | A | 12/1999 | Fettes |
| 6,000,072 | A | 12/1999 | LaHay |
| 6,032,305 | A | 3/2000 | Tedrick |
| 6,079,059 | A | 6/2000 | Girerd |
| 6,158,063 | A | 12/2000 | Tudor |
| 6,381,766 | B1 | 5/2002 | Perry |
| 6,393,630 | B1 | 5/2002 | Tedrick |
| 6,550,077 | B1 | 4/2003 | Tedrick |
| 6,601,834 | B2 | 8/2003 | Perry |
| 6,634,036 | B2 | 10/2003 | Tudor |
| 6,742,196 | B2 | 6/2004 | LaHay |
| 6,795,984 | B1 | 9/2004 | Brady |
| 6,842,917 | B1 | 1/2005 | Genova |

FOREIGN PATENT DOCUMENTS

WO PCT/US2006/12865 4/2006

*Primary Examiner*—Charles E. Phillips
(74) *Attorney, Agent, or Firm*—Kirkpatrick & Lockhart Preston Gates Ellis LLP

(57) ABSTRACT

A system for lifting a spa cover lifter. The system includes a pole and a post. The system also includes a first support member and a second support member. The first support member is pivotably connected to the pole. The second support member is pivotably connected to the pole and pivotably connected to the post. The system also includes a first cable connected to the spa cover, a second cable connected to the pole, and a drive mechanism connected to the first and second cables.

16 Claims, 12 Drawing Sheets

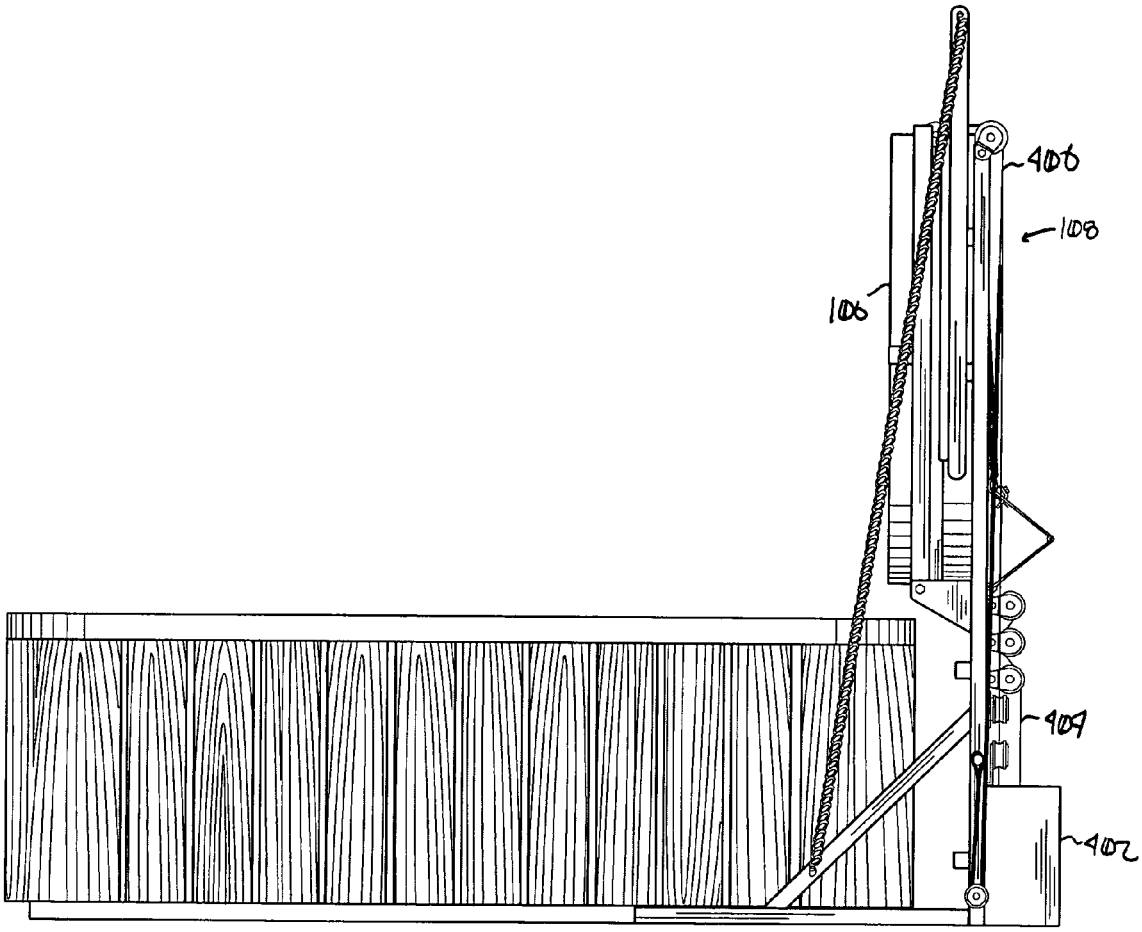
*Fig.* 13

SPA COVER LIFTER

BACKGROUND

The application is related, generally and in various embodiments, to a spa cover lifter. Many people today enjoy the recreational benefits of soaking in the hot water of a hot-tub or spa. Spas are popular at gyms and other recreational facilities, and many people even maintain spas at their private homes. Most spas are shielded by bulky covers when not in use. Especially with outdoor spas, the covers are often necessary to retain heat energy in the spa. The covers may also prevent debris, such as leaves, grass clippings, etc., from falling into the spa.

Due to their insulating properties, spa covers are often bulky and can sometimes be quite heavy. Removing and replacing a spa cover can be a nuisance to larger individuals, but may be extremely difficult for those of slighter builds. Systems exist for automatically opening and replacing spa covers, however, these systems are not designed for opening common types of spa covers.

SUMMARY OF THE INVENTION

In one general respect, the present application discloses a system for lifting a spa cover. According to various embodiments, the system comprises a pole and a post. The system also comprises a first support member and a second support member. The first support member is pivotably connected to the pole. The second support member is pivotably connected to the pole and pivotably connected to the post. In various embodiments, the system also comprises a first cable connected to the spa cover, a second cable connected to the pole, and a drive mechanism connected to the first and second cables.

In another general aspect, the present application discloses a method of lifting a spa cover from a spa. The spa cover comprises a first section and a second section. The first section and the second section are joined at a hinge interface. The method comprises the step of providing a first lifting force at an edge of the first section opposite the hinge interface. The method also comprises the step of providing a second lifting force at the hinge interface of the spa cover.

BRIEF DESCRIPTION OF THE FIGURES

FIG. 13 illustrates portions of a spa cover lifter installed on a spa according to various embodiments.

DETAILED DESCRIPTION

Figure 1:
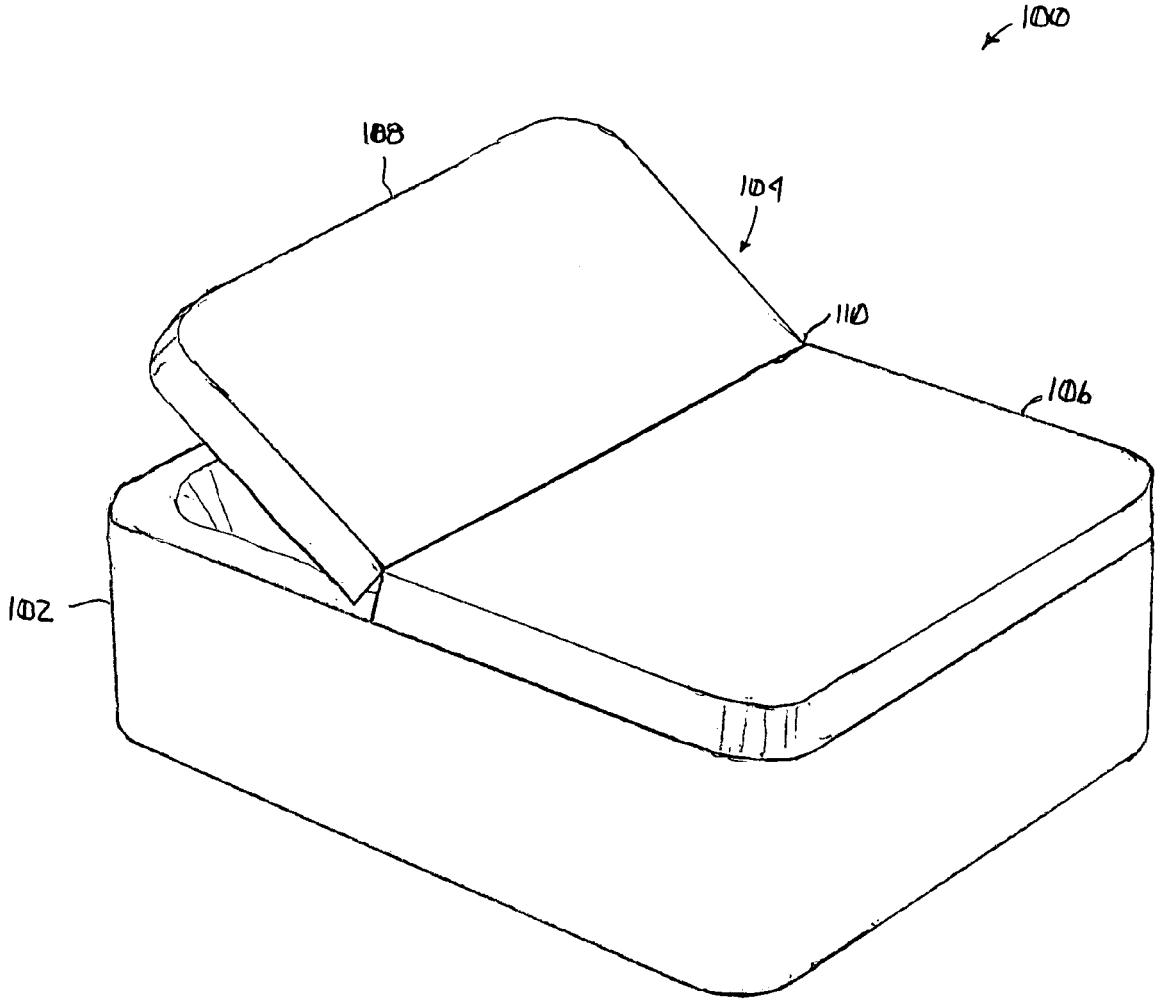
FIG. 1 illustrates a spa and spa cover according to various embodiments.

FIG. 1 illustrates a spa 100 according to various embodiments. The spa 100 may include a tub 102 and a cover 104. The tub 102 may be filled with water and, in various embodiments, may include filtration and heating equipment (not shown) as is known in the art. The spa cover 104 may include a core (not shown) made from a heat insulating material, such as, for example, polystyrene. The spa cover 104 may be covered in a waterproof lining, for example, made from vinyl or another suitable material. The cover 104 may include a first section 106 and a second section 108. The sections 106, 108 of the cover 104 may be pivotably joined at hinge interface 110. For example, the cover 104 may be folded at the hinge interface 110 as shown.

Figure 2:
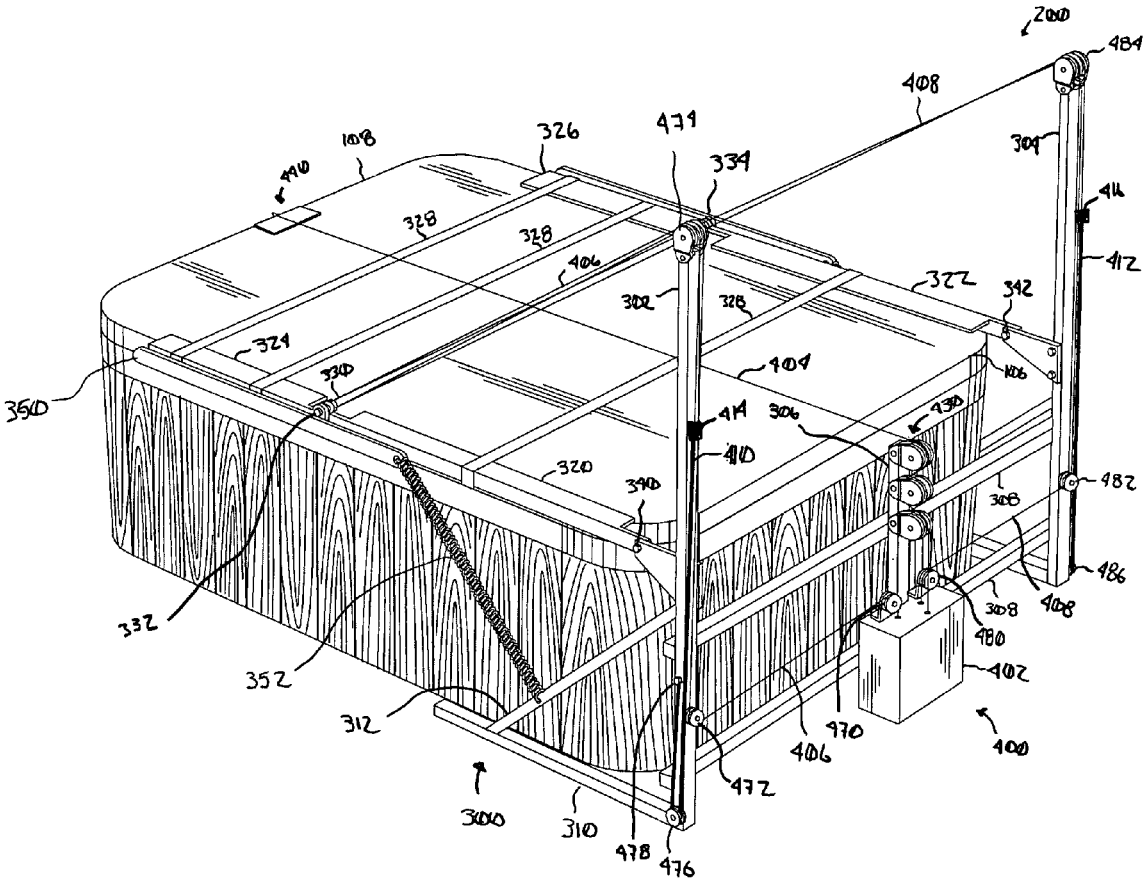
FIG. 2 illustrates portions of a spa cover lifter installed on a spa according to various embodiments.
Figure 3:
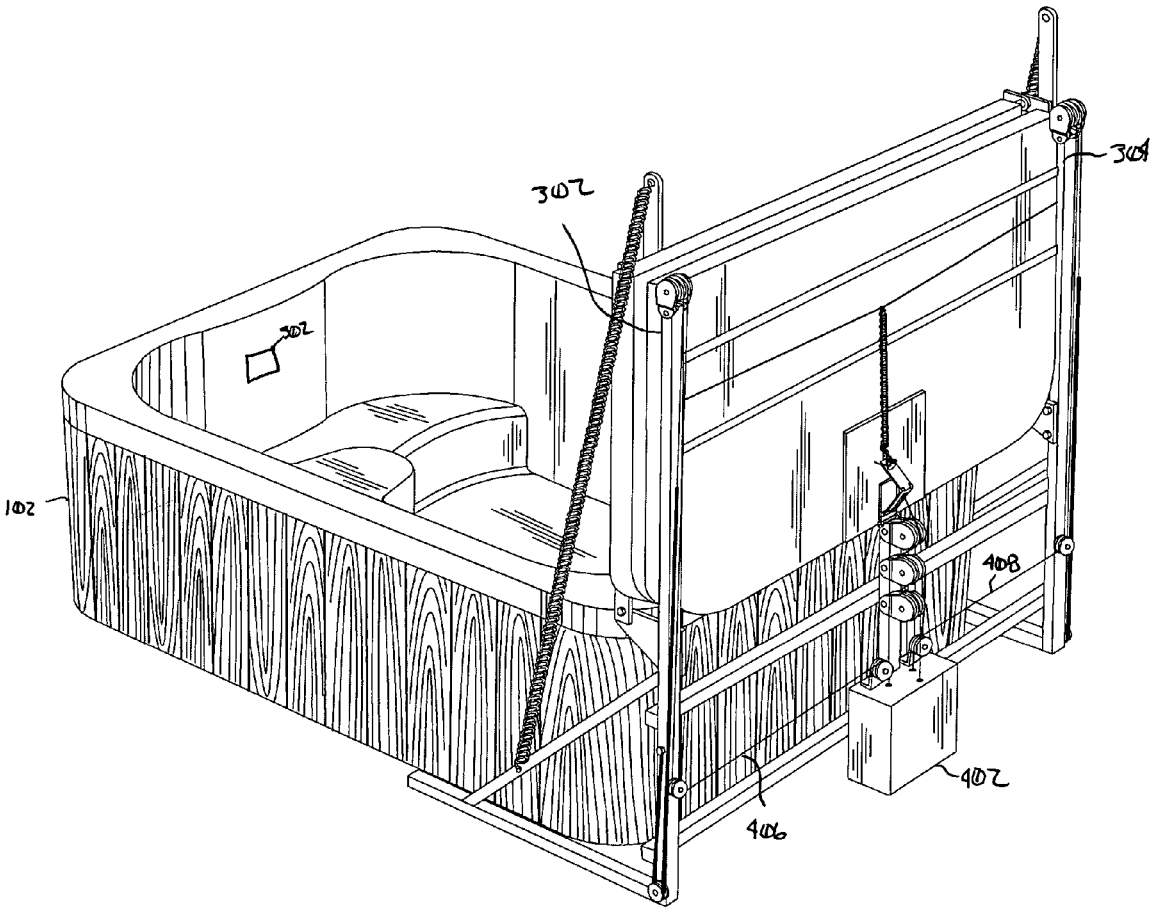
FIG. 3 illustrates portions of a spa cover lifter installed on a spa according to various embodiments.

FIGS. 2–8 depict various components of a spa cover lifter 200 installed on a spa 100 according to various embodiments. The spa cover lifter 200 may generally include a frame structure 300 and a drive system 400. The spa cover lifter 200 may cause the spa cover 104 to transition between a closed position, for example, as shown in FIG. 2, and an open position, for example, as shown in FIG. 3. Referring back to FIG. 2, the frame structure 300 of the spa cover lifter 200 may include a pair of posts 302, 304 for example, positioned at adjacent corners of the spa 100. The side of the spa 100 between the adjacent corners may correspond to section 106 of the spa cover 104. In various embodiments, a drive post 306 may be positioned between the posts 302, 304. The posts 302, 304, 306 may be supported by any suitable support structure. For example, FIG. 1 shows the posts 302, 304, 306 supported by cross-members 308, stand 310 and brace 312.

In various embodiments, the posts 302, 304, 306 and structure 308, 310, 312 may be secured to the spa 100. For example, one or more of the structures 302, 304, 306, 308, 310, 312 may be fastened to the spa tub 102 using any suitable fastener or fasteners including, for example, one or more screws, nails, rivets, etc. Also, the above structures may be fastened to the spa tub 102 using straps (not shown) made of any suitable material.

The frame structure 300 of the spa cover lifter 200 may further include support members 320, 322, 324, 326 fastened to the spa cover 104 and also fastened to one or more of the posts 302, 304, 306, as described below. The support members 320, 322, 324, 326 may be fastened to the spa cover 104 using straps 328 or any other suitable fastening method. For example, the support members 320, 322, 324, 326 may be secured to the spa cover 104 using fasteners, e.g., screws, rivets, etc., however it will be appreciated that fastening methods that require puncturing the spa cover 104 may cause damage and premature wear to the cover 104.

In various embodiments, the support members 320, 322, 324, 326 may be fastened to opposite edges of the spa cover 104. The opposite edges may be roughly bisected by the hinge interface 110 such that support members 320, 322 may be fastened along opposite edges of the first section 106 of the spa cover 104 and support members 324, 326 may be fastened along opposite edges of the second section 108 of the spa cover 104.

A pole 330 may be positioned across the spa cover 104 at roughly the location of the hinge interface 110. The pole 330 may meet with the pair of support members 320, 324 at interface 332 such that the support members 320, 324 may pivot relative to each other about the interface 332. The pole 330 may also interface with the pair of support members 322, 326 at interface 334, similarly allowing the support members 324, 326 to pivot relative to each other. Accordingly, as the spa cover 104 is folded about the hinge interface 110, the support members 320, 322, 324, 326 may be similarly folded about the pole 330.

The support members 320, 322, 324, 326 and pole 330 may be pivotably connected to at least one of the posts 302, 304, 306, directly or indirectly. For example, support members 320 and 322 may be connected to posts 302, 304 at hinges 340, 342 as shown in FIG. 2. Accordingly, the support members 320, 322 as well as the attached spa cover 104 may be pivoted off the spa tub 102 at hinges 340, 342.

In various embodiments, the frame structure 300 may also include means for storing and releasing a torque about hinge interface 110, e.g., also about interfaces 332 and 334. For example, FIG. 2 shows a lever arm 350 attached to support member 324 and extending towards post 302. A spring 352 may extend from an end of lever arm 350 to brace 312 or another suitable portion of the frame structure 300. It will be appreciated that a similar lever arm and spring (not shown) may, but need not be, mounted on the opposite side of the spa 100. The lever arm 350 and spring 352 may store a torque by extending the spring 352 as the spa cover section 108 folds upon the spa cover section 106. The torque may be released as the spa cover sections 106, 108 unfold relative to each other and tension in the spring 352 is released.

Figure 4:
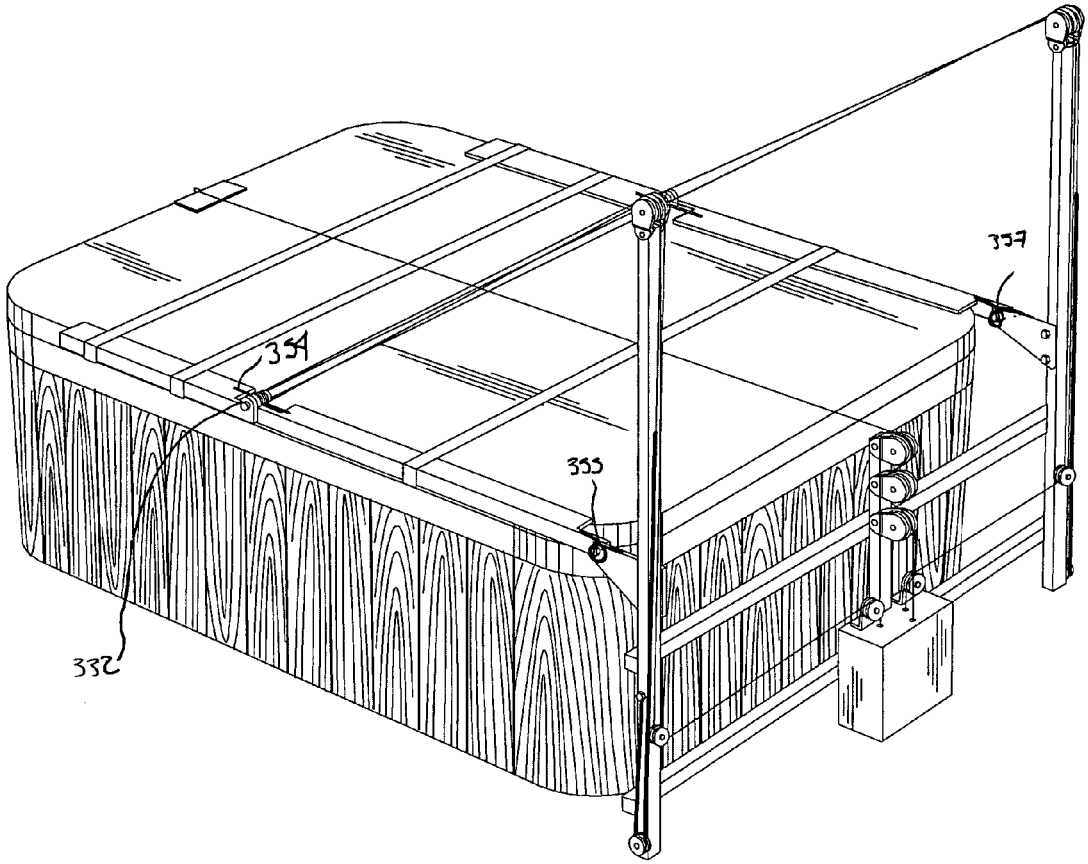
FIG. 4 illustrates a torsion spring installed on a spa cover lifter according to various embodiments.
Figure 5:
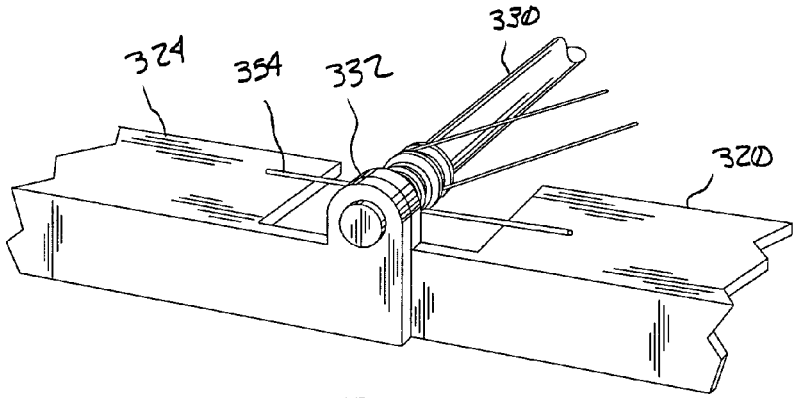
FIG. 5 illustrates a torsion spring installed on a spa cover lifter according to various embodiments.

In various embodiments, the means for storing and releasing a torque may include a torsion spring 354 as shown in FIGS. 4 and 5. A similar torsion spring (not shown) may, but need not be, mounted on the opposite side of the spa 100. As the support members 320 and 324 fold upon one another, the torsion spring 354 may be compressed. Accordingly, as the sections 106, 108 of the spa cover 104 fold upon one another, a torque is stored in the torsion spring. The torque may be released as the spa cover 104 unfolds, and the tension in the torsion spring 354 is released. In certain embodiments, torsion springs 355, 357 or other means for storing and releasing a torque, e.g., a lever arm and spring, etc., may be included about hinges 340 and 342 as well.

Referring back to FIG. 2, the spa cover lifter 200 may also include a drive system 400. The drive system 400 may include a drive mechanism 402 for providing power to the spa lifter 200. The drive mechanism 402 may be mounted to the drive post 306, and may provide power to the spa cover lifter 200 by retracting a series of cables 404, 406, 408 attached directly or indirectly to the spa cover 104. The drive mechanism 402 may be any kind of drive device including, for example, an electric motor, an internal combustion engine, etc. In various embodiments, the drive mechanism 402 may include an electric motor whose operating voltage is chosen to match that of the spa 100, e.g., 110 volts or 220 volts. This may allow the drive mechanism 402 to draw power from the spa 100.

Figure 6:
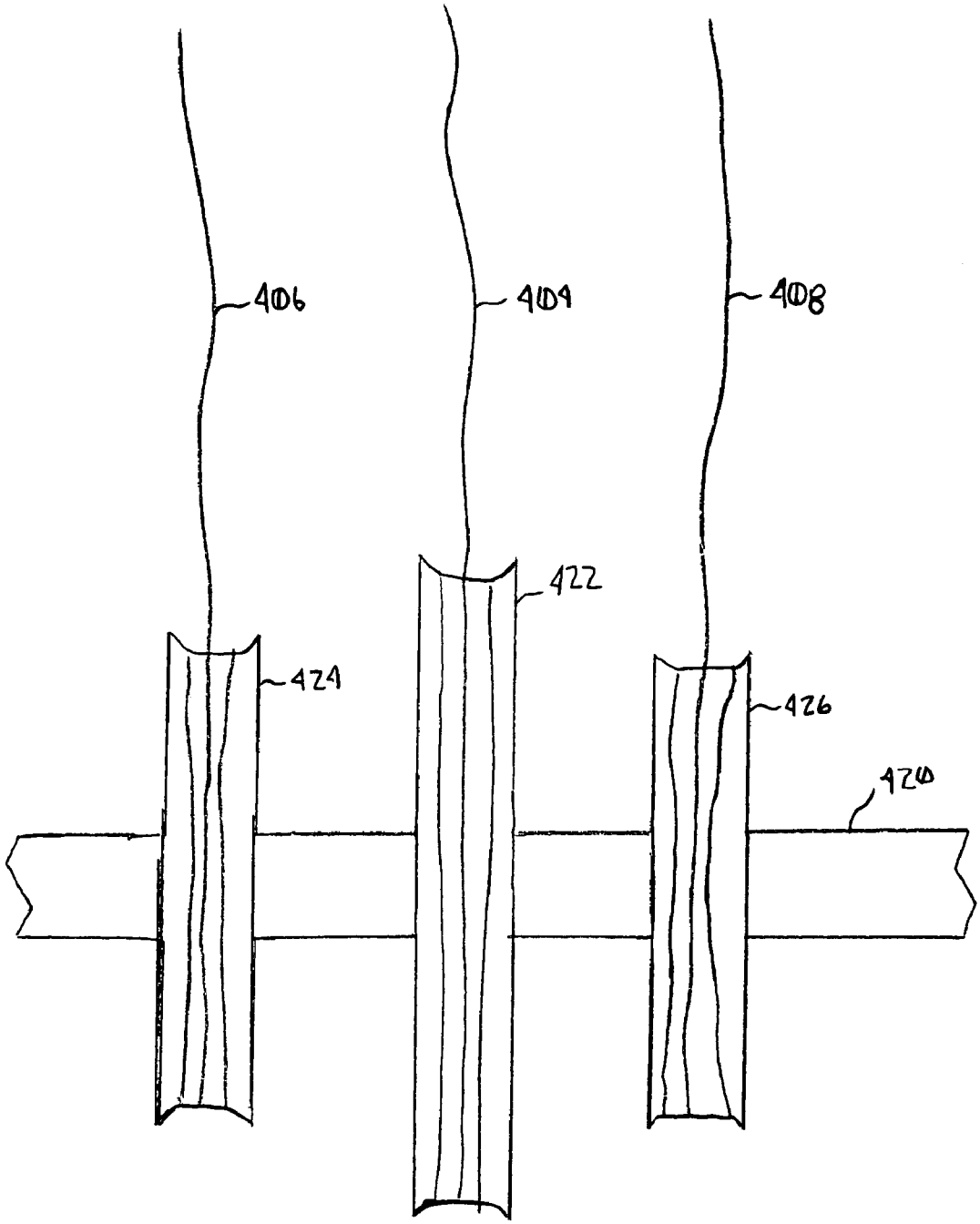
FIG. 6 illustrates a driveshaft for inclusion in a spa cover lifter according to various embodiments.

Cables 404, 406, 408 may extend, directly or indirectly, from the drive mechanism 402 to various points on the spa cover 104. FIG. 6 shows a driveshaft 420 that may be a part of the drive mechanism 402 according to various embodiments. The driveshaft 420 may include one or more spools 422, 424, 426. Each spool 422, 424, 426 may be connected to one or more of cables 404, 406, 408. As the driveshaft 420 rotates, the spools 422, 424, 426 may also rotate, causing the cables 404, 406, 408 to be retracted. In various embodiments, as described below, the spool 422 attached to the cable 404 may have a larger diameter than the spools 424, 426 attached to cables 406 and 408.

The cable 404 may be routed by one or more pulleys, e.g., pulley assembly 430, from the drive mechanism 402 to the spa cover 104. The cable 404 may be fastened to the spa cover 104, for example, through an interface assembly 440. The interface assembly 440 may be mounted to an edge of the spa cover 104 opposite the drive mechanism 402. For example, if the drive mechanism 402 is placed adjacent to side 106 of the cover 104 the interface assembly 440 may be placed adjacent to section 108, as shown in FIG. 2. For example, the interface assembly 440 may be placed along an edge of section 108 opposite the hinge interface 110.

Figure 7:
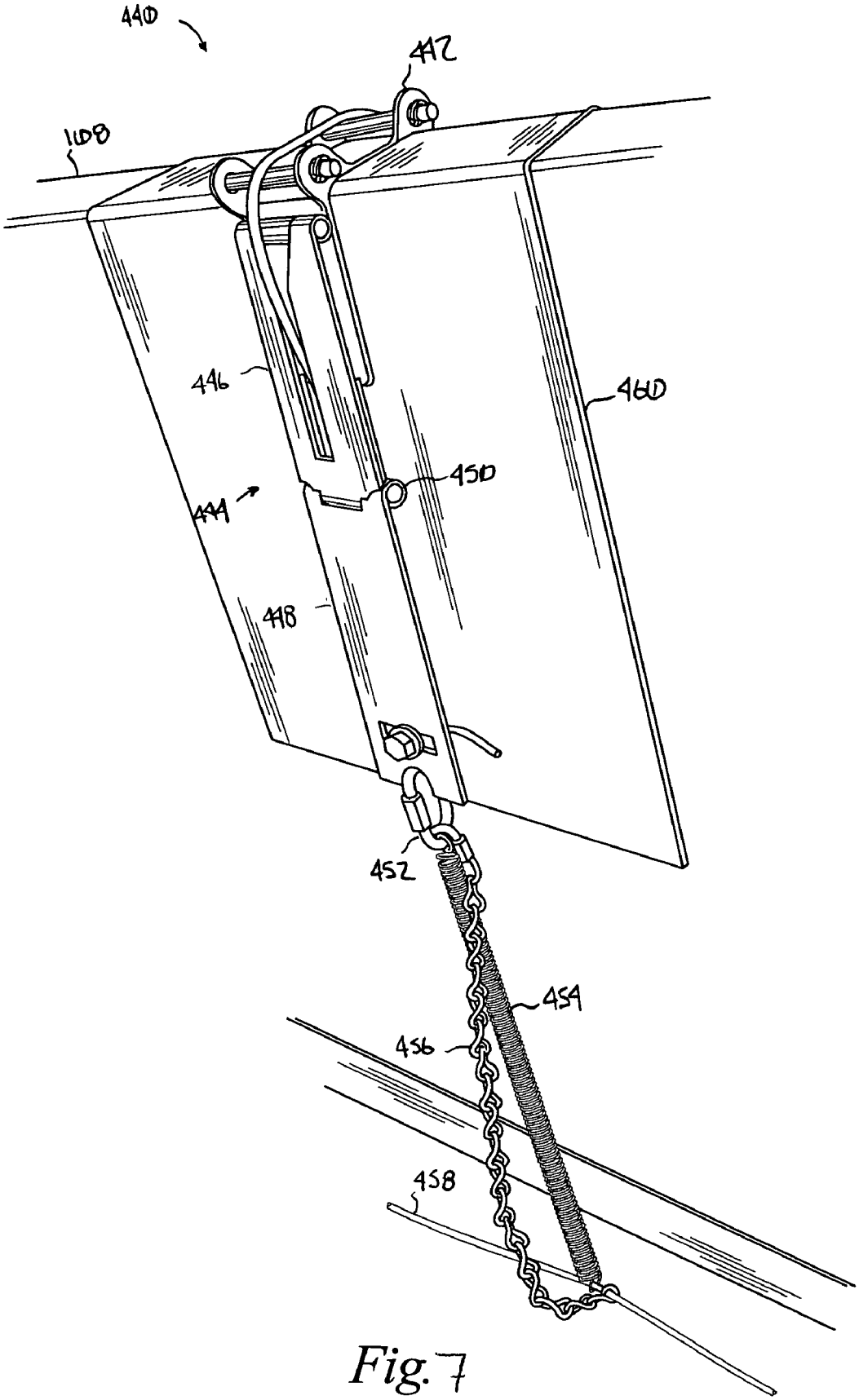
FIG. 7 illustrates portions of a spa cover lifter installed on a spa according to various embodiments.
Figure 8:
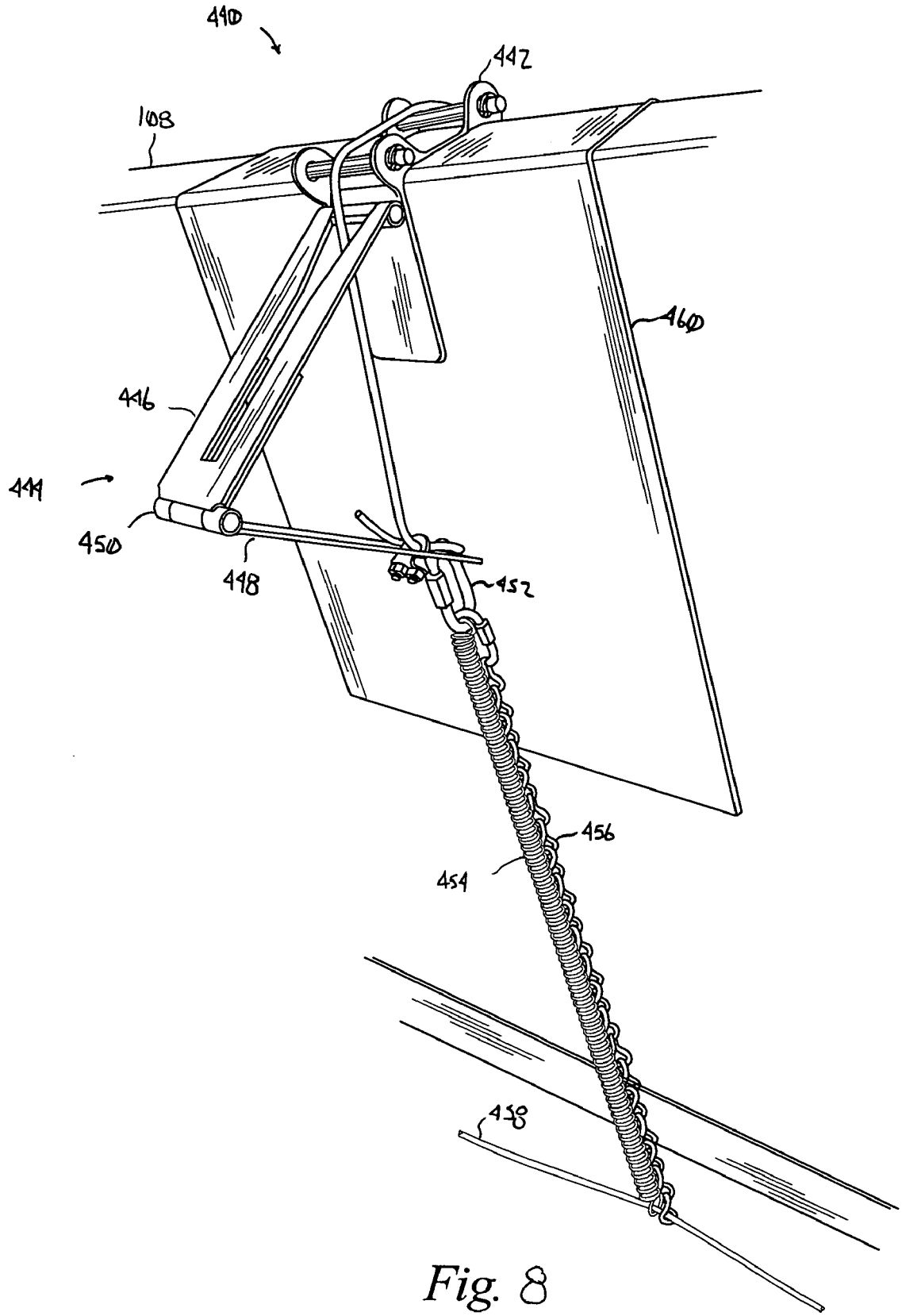
FIG. 8 illustrates portions of a spa cover lifter installed on a spa according to various embodiments.

FIGS. 7 and 8 show embodiments of the interface assembly 440. The interface assembly 440 may include a bracket 442, an interface device 444 (including a first section 446, a second section 448 and a hinge 450), a connector 452, a spring 454, a chain 456, a cable 458, and a plate 460. The plate 460 may be placed between section 108 of the spa cover 104 and the various other components of the interface assembly 440. The hinge 450 of the interface device 444 may join the first section 446 and the second section 448, allowing the two sections 446, 448 to pivot relative to each other. It will be appreciated that the interface device 444 may be mounted perpendicular to an edge of the section 108 as pictured in FIGS. 7 and 8, or may, in various embodiments, be mounted parallel to the edge of the section 108.

The cable 404 may meet the interface assembly 440 at interface bracket 442. Interface bracket 442 may route the cable 404 around section 108 of the spa cover 104 and through interface device 444, where it may be attached to connector 452 attached to the second section 448 of the interface device 444. The spring 454 and chain 456 may also be attached to the connector 452. The ends of the spring 454 and chain 456 not attached to the connector 452 may be secured to the spa cover 104 and/or frame structure 300, for example, by cable 458. In various embodiments, the unextended length of the spring 454 may be shorter than the length of the chain 456.

When the spa cover 104 is in a closed position, the interface device 444 may lie flat between the section 108 of the spa cover 104 and the spa tub 102. As the cable 404 is retracted, for example, by the drive mechanism 402, the second section 448 of the interface device 444 may be drawn towards the first 446, extending the spring 454 and causing the two sections 446, 448 of hinge 450 to bend. As a result, a force may be exerted between the section 108 of the spa cover 104 and the spa tub 102. This may cause the section 108 to raise and pivot relative the section 106 of the spa cover 104. The motion of the interface device 444 may continue until chain 334 is engaged, arresting further motion of the hinge assembly 450.

Referring back to FIG. 2, in various embodiments, the cable 406 may extend from the drive mechanism 402 to the interface 332 between the pole 330, and the support members 320, 324. After exiting the drive mechanism 402, the cable 406 may be routed towards the post 302 by pulley 470. Pulley 472 may route the cable 406 toward the top of the post 302 where post pulley 474 may route the cable 406 toward interface 332. At interface 332, the cable 406 may be routed back towards post pulley 474. For example, the cable 406 may be wrapped around the pole 330 and/or a pulley (not shown) generally positioned near interface 332. Back at post pulley 474, the cable 406 may be routed down the post 302 to pulley 476, which may route the cable 406 up the post 302 to termination point 478. In various embodiments, the cable 406 may include an elastic section 408, for example, extending between the post pulley 474 and the termination point 478. It will be appreciated that the cable 408 may be routed similarly to the cable 406. For example, the cable 408 may extend through pulleys 480, 482, 484, to interface 334. From interface 334, the cable 408 may route back to the pulley 484, through pulley 486, and be connected to the frame structure 300 at a termination point (not shown). The cable 408 may also have an elastic section 412 similar to that of the cable 406.

Figure 9:
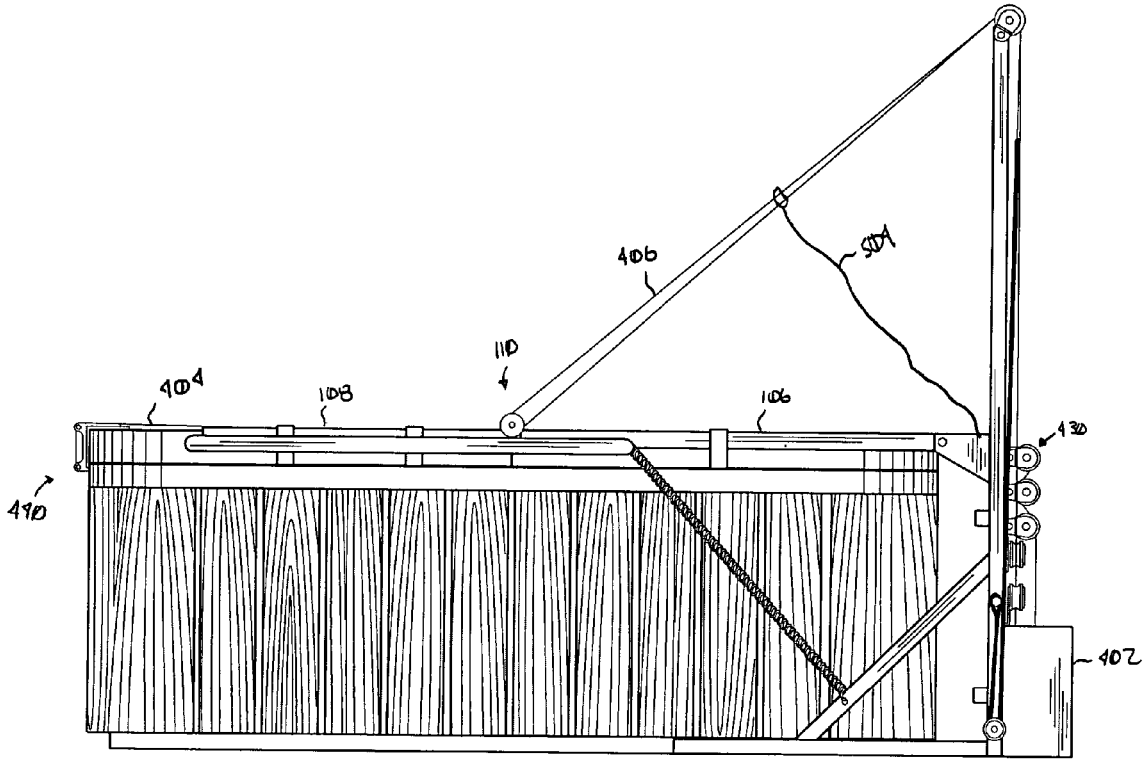
FIG. 9 illustrates portions of a spa cover lifter installed on a spa according to various embodiments.
Figure 10:
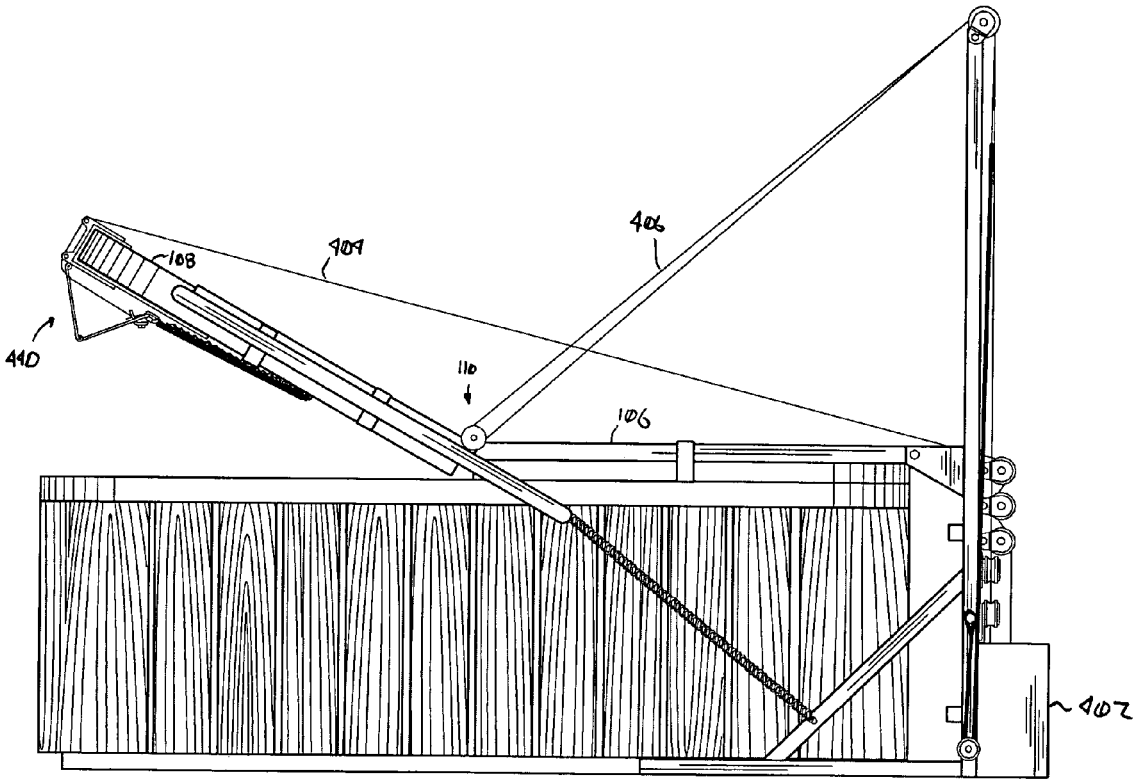
FIG. 10 illustrates portions of a spa cover lifter installed on a spa according to various embodiments.
Figure 11:
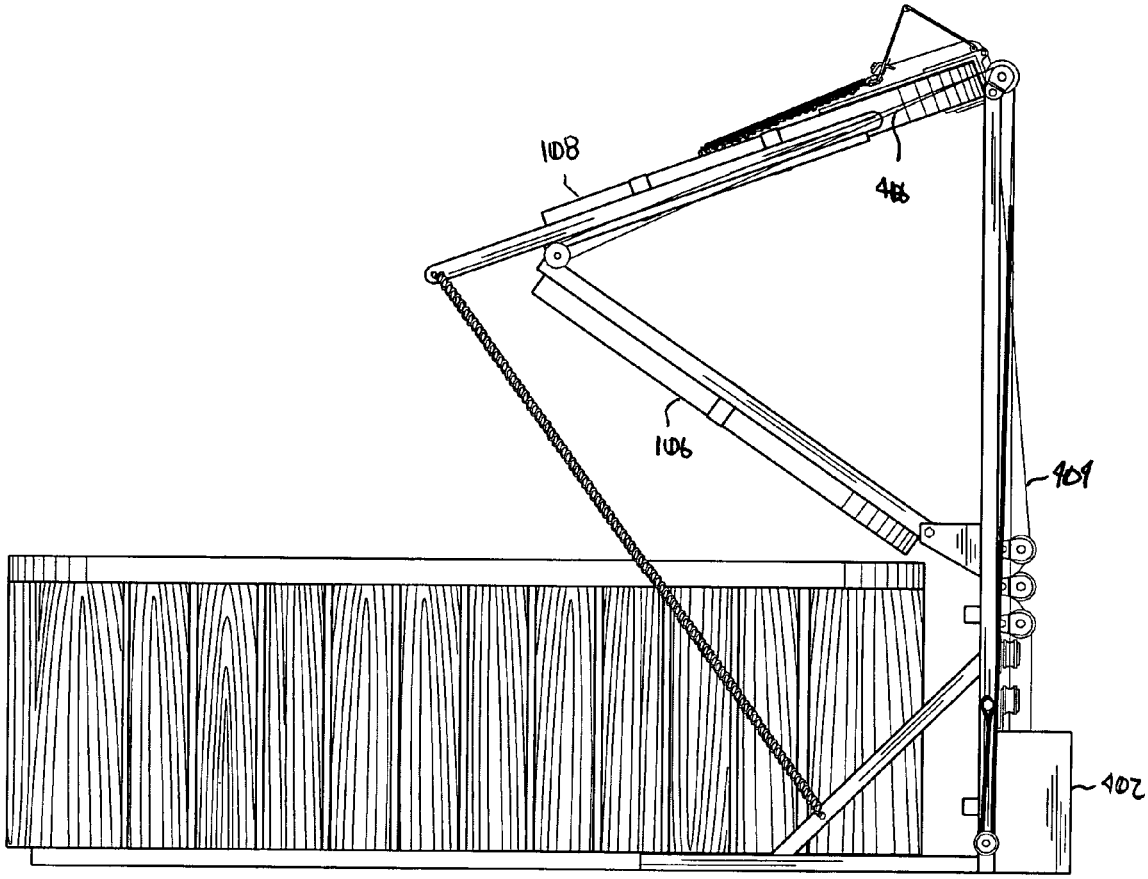
FIG. 11 illustrates portions of a spa cover lifter installed on a spa according to various embodiments.
Figure 12:
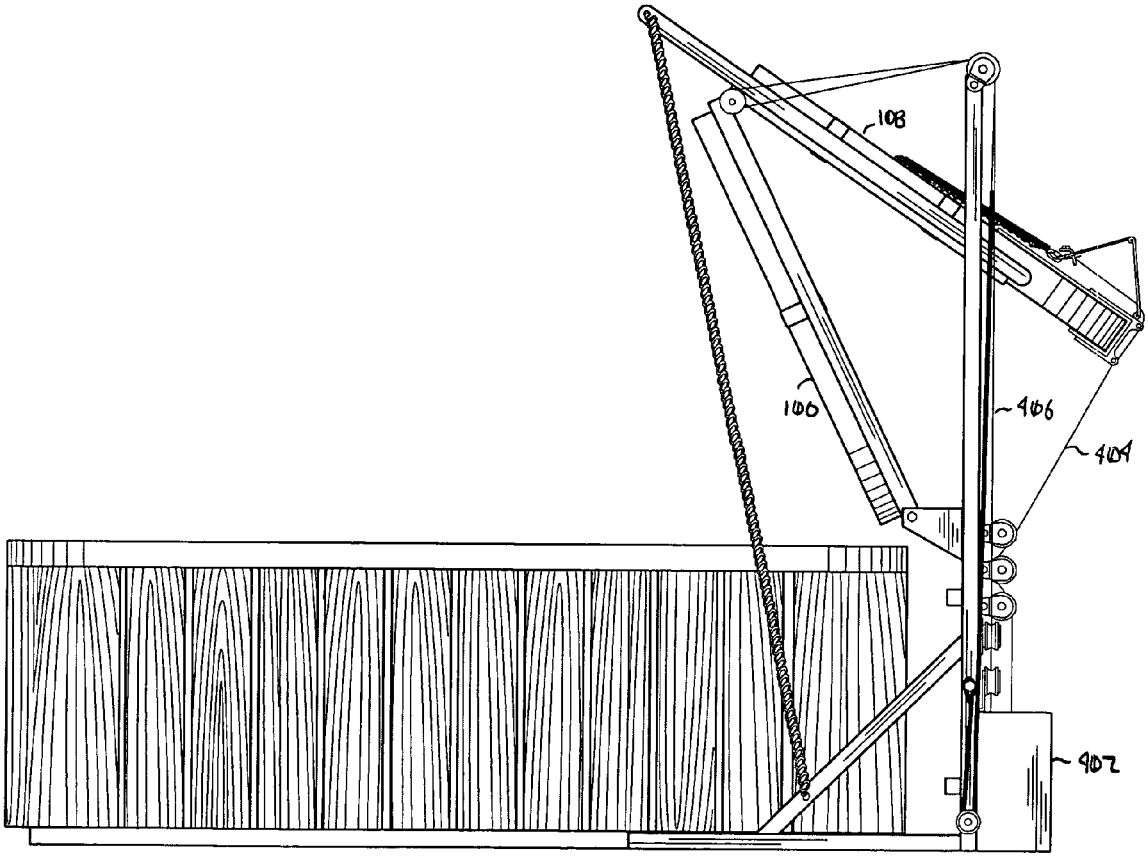
FIG. 12 illustrates portions of a spa cover lifter installed on a spa according to various embodiments.

FIGS. 9–13 show a sequence for using the spa cover lifter 200 to transition the spa cover 104 between a closed position, for example, as shown in FIG. 9, and an open position, for example, as shown in FIG. 13. To begin the transition, the drive mechanism 402 may initially apply a first lifting force to the section 108 of the spa cover 104 by retracting cable 404. The first lifting force may cause section 108 of the spa cover 104 to fold towards the section 106 along hinge interface 110. Relative to the section 106, the section 108 may be pivoted through about 180 degrees. The first lifting force may be maintained, e.g., the cable 404 may be continually retracted, until the section 108 of the spa cover 104 is substantially folded against the section 106. It will be appreciated that folding the spa cover 104 may cause the means for storing and releasing a torque, for example, lever arm 350 and spring 352 and/or torsion spring 354, to store a torque resulting from the folding.

In various embodiments, the interface assembly 440 may help guide the first lifting force in a vertical direction and/or break any seal that may have formed between the spa cover 104 and the spa 100. For example, as the cable 404 is retracted, the interface device 444 may lift the section 108 of the spa cover 104 from the spa tub 102. This may break any seal existing between the section 108 and the spa tub 102. Also, the upward motion of the section 108 may change the angle between the section 108 and the cable 404, causing the direction of the force exerted by the cable 404 to transition towards a more vertical direction, further lifting the section 108.

The drive mechanism 402 may also provide a second lifting force by retracting one or more of the cables 406, 408. In various embodiments, the cables 406, 408 may be retracted simultaneously. The second lifting force may cause the spa cover 104, e.g., through support members 320, 322, 324, 326, to rotate off of the spa tub 102 at hinges 340, 342. The second lifting force may be maintained until the spa cover 104 is pivoted off the spa 100 to a position that generally allows bathing in the spa 100, e.g., about 90 degrees relative to the spa tub 102. It will be appreciated that in embodiments where one or more torsion springs 355, 357 or other means for storing and releasing a torque is included at one or both of hinges 340, 342, rotating the spa cover 104 of the spa tub 102 may store a torque in the torsion springs 355, 357 or other means for storing and releasing a torque.

Transitioning the spa cover 104 from a closed position to an open position may require pivoting the section 108 through a greater distance and angle than the section 106. Accordingly, transitioning from a closed position to an open position may require the drive mechanism 402 to retract a length of the cable 404 that is greater than the retracted length of the cables 406, 408. This differential retraction may be accomplished in any suitable manner.

For example, in various embodiments, the cable 404 and the cables 406, 408 may be retracted simultaneously and at substantially the same rate, e.g., the spools 422, 424, 426 may be of substantially the same diameter. The application of tension in the cables 406, 408, however, and thus the application of the second lifting force, may be delayed until the section 108 of the spa cover 104 has pivoted through a predetermined distance and/or angle. For example, when the cables 406, 408 are initially retracted, they may expand, eliminating or significantly reducing any force exerted on the interfaces 332, 334 or the spa cover 104. The cables 406, 408 may expand, for example, in their respective elastic sections 410, 412.

When the section 108 of the spa cover 104 has pivoted through the predetermined distance and/or angle, the expansion of the cables 406, 408 may be arrested, causing the second lifting force to be applied. In various embodiments, stops 414, 416 may be strategically placed on the cables 406, 408. As the cables 406, 408 expand, the stops 414, 416 may reach the post pulleys 474, 484, for example, after the spa cover 104 has pivoted through the predetermined distance and/or angle. Interaction between the stops 414, 416 and the post pulleys 474, 484 may prevent further expansion of the cables 406, 408, causing the second lifting force to be applied. It will be appreciated that the stops 414 may be mounted anywhere on the cables 406, 408 that allows them to contact post pulleys 414, 416, or any other pulleys or structure, after the spa cover 104 has pivoted through the predetermined distance or angle. For example, the stops 414, 416 may be mounted between the post pulleys 474, 484 and pulleys 476, 486. In other various embodiments, the stops 414, 416 may be mounted between the post pulleys 474, 484 and the interfaces 332, 334.

The expansion of the cables 406, 408 may also be accomplished by strategically choosing the length and material of the cables 406, 408. For example, the material and length of the cables 406, 408 including elastic portions 410, 412, may be chosen such that the cables 406, 408 reach their maximum length when the first section 108 has been pivoted through the predetermined distance and/or angle.

The differential retraction of the cables 404, 406, 408 may also be accomplished, for example, by retracting the cable 404 and the cables 406, 408 for different amounts of time and/or at different rates. In various embodiments, for example, the cable 404 and the cables 406, 408 may be retracted by separate drive mechanisms (not shown). This may allow the cable 404 and the cables 406, 408 to be retracted at different times and rates to accommodate the lifting of the spa cover 104.

Also, in various embodiments, the cable 404 and the cables 406, 408 may be retracted simultaneously, albeit at different rates. For example, the spool 422 corresponding to the cable 404 may have a larger diameter than the spools 424, 426 corresponding to the cables 406, 408. This may cause the cable 404 to be retracted at a greater rate than the cables 406, 408, even though the driveshaft 420 may rotate the spools 422, 424, 426 at the same rate. The difference in diameter between the spool 422 and the spools 424, 426 may be chosen such that both sections 106, 108 of the spa cover 104 reach an open position after the same number of rotations of the driveshaft 420.

According to various embodiments, the spa cover lifter 200 may also transition the spa cover 104 from an open position to a closed position. For example, the spa cover lifter 200 may perform the sequence shown in FIGS. 9–13 in reverse. Instead of retracting cables 404, 406, 408, the drive mechanism may extend the cables. It will be appreciated that gravity may cause the spa cover 104 to rotate toward the spa tub 102 as the cables 404, 406, 408 are extended. In embodiments where a torsion spring (not shown), or other means for storing and releasing a torque, are included at hinge 340 and/or hinge 342, releasing the cables 404, 406, 408 may cause a torque stored in the torsion spring (not shown) or other means to be released, further causing the spa cover 104 to rotate towards the spa tub 102.

In addition, as the cable 404 is extended the torque stored by the means for storing and releasing a torque may be released, causing the section 108 of the spa cover 104 to unfold away from the section 106. This may initially move the center of mass of the spa cover 104 toward the center of the spa tub 102, enhancing the effects of gravity. As the spa cover 104 nears a closed position, the release of the torque may cause the sections 106, 108 to completely unfold, thus completing the closing transition.

The spa cover lifter 200 may include various safety features. For example, the spa cover lifter 200 may include a safety sensor 502 for sensing motion in the water of the spa 100 as shown in FIG. 3. The safety sensor 502 may be wired to the drive mechanism 402 and may be configured to prevent the drive mechanism 402 from placing the spa cover 104 in a closed position while motion is detected in the spa tub 102. This may prevent the spa cover 104 from being closed while a person is still using the spa 100. The safety sensor 502 may be mounted to an interior wall of the spa tub 100 as shown in FIG. 3, or in various embodiments, may be a free-floating sensor. The spa cover lifter 200 may also include a safety activation button (not shown). The safety activation button may require a user of the spa cover lifter 200 to hold the activation button down for a given length of time, e.g., five seconds, before this spa cover lifter 200 begins to open or close the spa cover 104. This may prevent an inadvertent activation of the spa cover lifter 200.

In various embodiments, the spa lifter 200 may also include devices for dressing the various cables 404, 406, 408 while the spa 100 and spa lifter 200 are not in use. For example, maintaining the cables 406, 408 in a substantially straight line between the post pulleys 474, 484 and the pole 330 may create a hazard, as people may trip over the cables 406, 408, or become entangled. Therefore, in various embodiments, an elastic cord 504 may be stretched between one or more components of the frame structure 300 and cables 406, for example as shown in FIG. 9.

The elastic cord 504 may exert a force on the cable 406 tending to pull it towards the frame structure 300. The tension on the elastic cord 504 may be chosen so that the force exerted on the cable 406 has a minimal effect on the operation of the spa lifter 200. When the spa cover 104 is in a closed position, the drive mechanism 402 may be configured to extend the cable 406 slightly, allowing the tension on the elastic cord 504 to pull the cable 406 toward the frame structure 300. Accordingly, the cable 406 may be stored against the frame structure 300. It will be appreciated that a similar elastic cord (not shown) may be installed between the cable 408 and the frame structure 300.

Unless otherwise indicated, all numbers expressing quantities, dimension, and so forth used in the present specification and claims are to be understood as being modified in all instances by the term "about." Accordingly, unless indicated to the contrary, the numerical parameters set forth in the following specification and claims are approximations that may vary depending upon the properties sought to be obtained by the present invention.

While several embodiments of the invention have been described, it should be apparent that various modifications, alterations and adaptations to those embodiments may occur to persons skilled in the art with the attainment of some or all of the advantages of the present invention. For example, the number and position of the cables, pulleys, posts, etc. may vary. The instant description is therefore intended to cover all such modifications, alterations and adaptations without departing from the scope and spirit of the present invention as defined by the claims.

I claim:

1. A system for lifting a spa cover, the system comprising:
a pole;
a post;
a first support member pivotably connected to the pole;
a second support member pivotably connected to the pole and pivotably connected to the post;
a first cable connected to the spa cover;
a second cable connected to the pole; and
a drive mechanism connected to the first and second cables.

2. The system of claim 1, wherein the second cable is connected to the pole proximate the second support member.

3. The system of claim 1, wherein the first cable is connected to an edge of the spa cover opposite the drive mechanism.

4. The system of claim 1, wherein the drive mechanism comprises a drive shaft having a first spool and a second spool.

5. The system of claim 4, wherein
the first spool is connected to the first cable; and
the second spool is connected to the second cable.

6. The system of claim 5, wherein a diameter of the first spool is larger than a diameter of the second spool.

7. The system of claim 1, wherein the drive mechanism comprises an electric motor.

8. The system of claim 1, further comprising a pulley connected to the post, wherein the second cable is routed by the pulley.

9. The system of claim 8, further comprising a second pulley wherein the first cable is routed by the second pulley.

10. The system of claim 1, further comprising:
a second post;
a third support member pivotably connected to the pole;
a fourth support member pivotably connected to the pole and pivotably connected to the second post; and
a third cable connected to the pole.

11. The system of claim 10, wherein the second post is substantially parallel to the post.

12. The system of claim 10, further comprising a third pulley connected to the second post, wherein the third cable is routed by the third pulley.

13. The system of claim 1, further comprising means for storing and releasing a torque along an axis substantially parallel to the pole.

14. The system of claim 1, further comprising a safety sensor, wherein the safety sensor is configured to prevent the spa cover from closing on a spa when motion is sensed within the spa.

15. The system of claim 1, further comprising an interface bracket installed between the first cable and the spa cover.

16. The system of claim 1, further comprising means for storing and releasing a torque positioned at an interface between the post and the second support member.

* * * * *